US008899779B2

(12) United States Patent
Linehan et al.

(10) Patent No.: US 8,899,779 B2
(45) Date of Patent: Dec. 2, 2014

(54) ILLUMINATOR HAVING IMPROVED DISTANCE ILLUMINATION

(75) Inventors: Daniel Linehan, Cork (IE); Tomas Hennessy, County Cork (IE); Andrew Cronin, County Cork (IE); Richard Pierre Joseph Debarbouille, County Cork (IE)

(73) Assignee: Naulight Limited, Cork (IE)

( * ) Notice: Subject to any disclaimer, the term of this patent is extended or adjusted under 35 U.S.C. 154(b) by 9 days.

(21) Appl. No.: 13/821,861

(22) PCT Filed: Sep. 9, 2011

(86) PCT No.: PCT/IE2011/000051
§ 371 (c)(1),
(2), (4) Date: Apr. 24, 2013

(87) PCT Pub. No.: WO2012/032504
PCT Pub. Date: Mar. 15, 2012

(65) Prior Publication Data

US 2013/0201675 A1 Aug. 8, 2013

(30) Foreign Application Priority Data

Sep. 10, 2010 (IE) ..... 2010/0568

(51) Int. Cl.
*F21V 7/00* (2006.01)
*F21V 13/04* (2006.01)
(Continued)

(52) U.S. Cl.
CPC ..... *F21V 7/005* (2013.01); *F21Y 2101/02* (2013.01); *F21W 2131/405* (2013.01); *F21V 21/30* (2013.01); *F21S 4/008* (2013.01); *F21Y 2103/003* (2013.01); *A47F 11/10* (2013.01); *F21V 14/04* (2013.01); *F21V 15/013* (2013.01); *F21V 13/04* (2013.01); *F21V 15/011* (2013.01); *F21V 7/0025* (2013.01); *F21V 5/004* (2013.01)
USPC ..... 362/224; 362/217.05; 362/223

(58) Field of Classification Search
USPC ..... 362/217.05, 224, 223
See application file for complete search history.

(56) References Cited

U.S. PATENT DOCUMENTS 7,934,851 B1 * 5/2011 Boissevain et al. ..... 362/241
2008/0037239 A1 2/2008 Thomas
(Continued)

FOREIGN PATENT DOCUMENTS

| | | |
|---|---|---|
| EP | 2019252 | 1/2009 |
| WO | 2006/067777 | 6/2006 |
| WO | 2008/047335 | 4/2008 |

*Primary Examiner* — Tracie Y Green
(74) *Attorney, Agent, or Firm* — Jacobson Holman Hershkovitz, PLLC.

(57) ABSTRACT

An illuminator (1) an elongate inner housing (10) having a substrate (20) on which there is a linear array of light emitting diodes (24), wherein the diodes have sufficient power for illuminating objects at a distance of at least 1.5 m. A drive circuit (30, 31) is mounted in an upper compartment of an outer housing (2) at least partly surrounding the inner housing (10). There is a diffuser (22) over the diodes. There is a pair of side reflectors extending substantially parallel to an axis of the illuminator, being side walls (26) of the inner housing. The inner housing (10) is coupled to the outer housing (2) in a modular manner so that it is interchangeable. There is a series of reflector baffles (23) extending from a plane of the diodes at intervals along the length of the inner housing. The baffles (23) have textured surfaces and have a dimension normal to the substrate sufficient to act as visors to limit glare in the longitudinal direction.

20 Claims, 6 Drawing Sheets

(51) Int. Cl.

| | |
|---|---|
| ***F21V 21/30*** | (2006.01) |
| ***A47F 11/10*** | (2006.01) |
| ***F21V 14/04*** | (2006.01) |
| ***F21V 15/01*** | (2006.01) |
| ***F21V 5/00*** | (2006.01) |
| *F21Y 101/02* | (2006.01) |
| *F21W 131/405* | (2006.01) |
| *F21S 4/00* | (2006.01) |
| *F21Y 103/00* | (2006.01) |

(56) References Cited

U.S. PATENT DOCUMENTS

| | | | | |
|---|---|---|---|---|
| 2008/0080175 | A1* | 4/2008 | Lee et al. | 362/223 |
| 2009/0040782 | A1 | 2/2009 | Liu | |
| 2010/0271816 | A1* | 10/2010 | Ozeki et al. | 362/217.05 |
| 2013/0208461 | A1* | 8/2013 | Warton et al. | 362/219 |

* cited by examiner

ILLUMINATOR HAVING IMPROVED DISTANCE ILLUMINATION

This is a national stage of PCT/IE11/000051 filed Sep. 9, 2011 and published in English, which has a priority of Irish no. 2010/0568 filed Sep. 10, 2010, hereby incorporated by reference.

INTRODUCTION

The invention relates to LED Illuminators.

Our prior PCT published patent specifications WO2006067777 and WO2008047335 describe illuminators for retail applications. They are suitable for illumination from a short distance, within or alongside a display cabinet.

However there are situations in retail and other display situations where it is not convenient to illuminate from such short distances. An example is a set of open shelves for goods such as vegetables. Heretofore, the approach has been to use general blanket lighting fixtures typically by fluorescent light fittings.

The invention is directed towards providing for improved distance illumination for such situations.

SUMMARY OF THE INVENTION

According to the invention, there is provided an illuminator comprising:

an elongate inner housing having a substrate on which there is a linear array of light emitting diodes, wherein the diodes have sufficient power for illuminating objects at a distance of at least 1.5 m, a drive circuit or connector to a drive circuit, and an outer housing at least partly surrounding the inner housing.

In one embodiment, the illuminator further comprises a diffuser over the diodes.

In one embodiment, the diffuser comprises a lenticular array of small cylindrical lenses.

In one embodiment, the diffuser is of overall rectangular shape extending along the length of the illuminator inner housing.

In one embodiment, the diffuser is curved along the direction of the axis of the small cylinder lenses so as to minimise Fresnel losses.

In one embodiment, the diodes include red, white and green diodes interspersed in a pattern.

In one embodiment, the diodes include white-only, or white and red, or white and red and green diodes.

In one embodiment, the illuminator further comprises a pair of side reflectors extending substantially parallel to an axis of the illuminator.

In one embodiment, said reflectors are side walls of the inner housing.

In one embodiment, the inner housing is coupled to the outer housing in a modular manner so that it is interchangeable.

In one embodiment, there is a series of reflector baffles extending from a plane of the diodes at intervals along the length of the inner housing.

In one embodiment, the baffles have textured surfaces.

In one embodiment, the baffles diverge from associated diodes.

In one embodiment, each baffle has a triangular configuration, opposed faces of which are for juxtaposed diodes.

In one embodiment, the baffles have a dimension normal to the substrate sufficient to act as visors to limit glare in the longitudinal direction.

In one embodiment, the outer housing has a top wall and side walls.

In one embodiment, the inner housing is rotatably mounted within the outer housing by a coupler.

In one embodiment, a first side wall of the outer housing extends further away from the diodes than the outer side wall, said first side wall lower edge forming a visor to limit lateral glare.

In one embodiment, the outer housing side walls are curved with a convex shape, curved inwardly at their lower edges.

In one embodiment, the coupler is adapted to allow a limited range of rotation.

In one embodiment, said range is set by engagement of a stop piece in a slot between the inner housing and the outer housing.

In one embodiment, the coupler comprises an inner housing end cap at each end and an outer housing fixture at each end, the end cap and the fixture at each end being configured for rotary inter-engagement.

In one embodiment, the coupler includes a resilient latch arranged to engage a receiver at any of a plurality of discrete positions, providing stepped mutual rotation.

In one embodiment, the outer housing side walls and top wall define an upper compartment housing at least a higher voltage part of the drive circuit and support fixtures.

In one embodiment, an outer surface of the inner housing and both inner and outer surfaces of the outer housing have high emissivity coatings.

DETAILED DESCRIPTION OF THE INVENTION

Brief Description of the Drawings

The invention will be more clearly understood from the following description of some embodiments thereof, given by way of example only with reference to the accompanying drawings in which.

DESCRIPTION OF THE EMBODIMENTS

Figure 1:
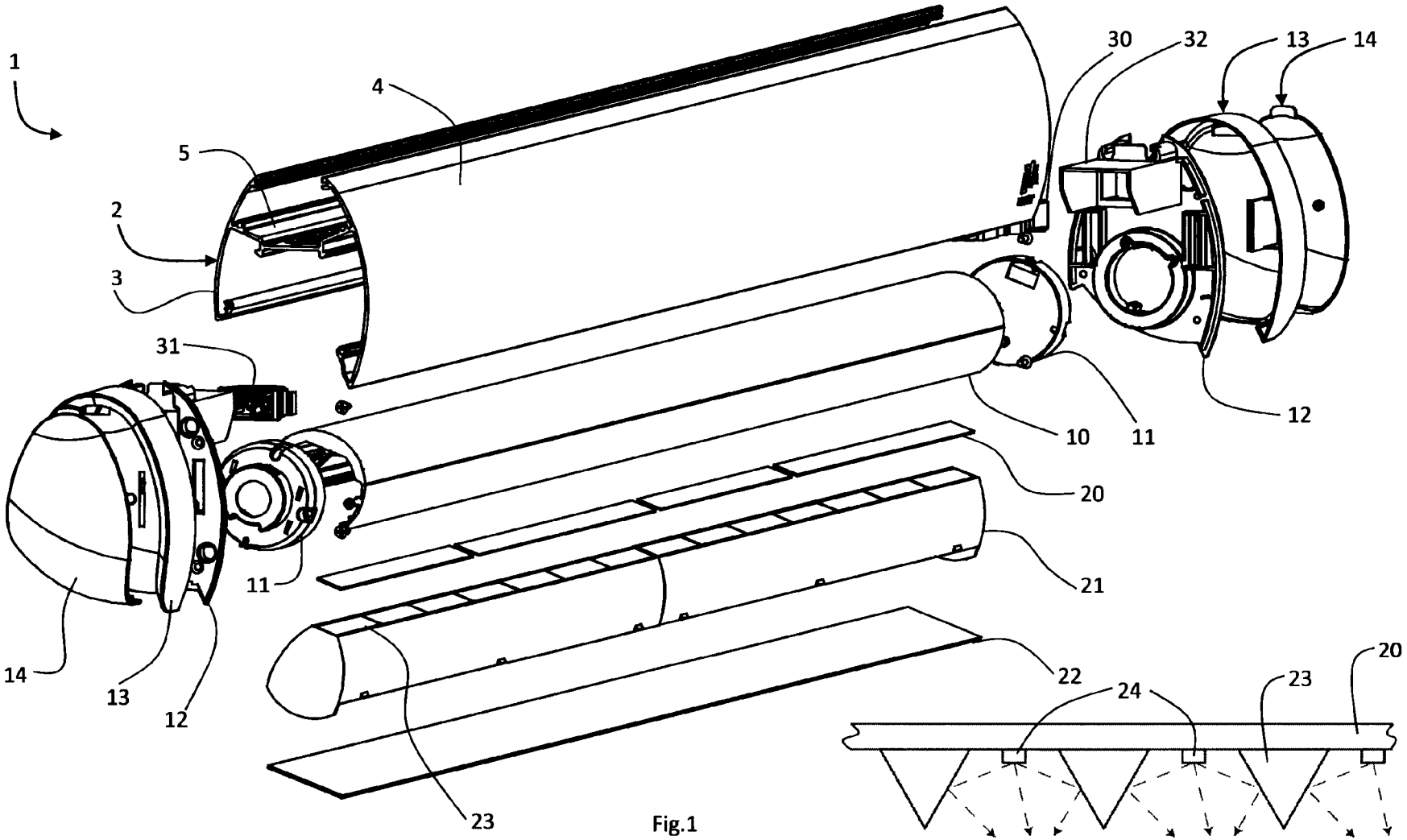
FIG. 1 is an exploded view of an illuminator of the invention.
Figure 2:
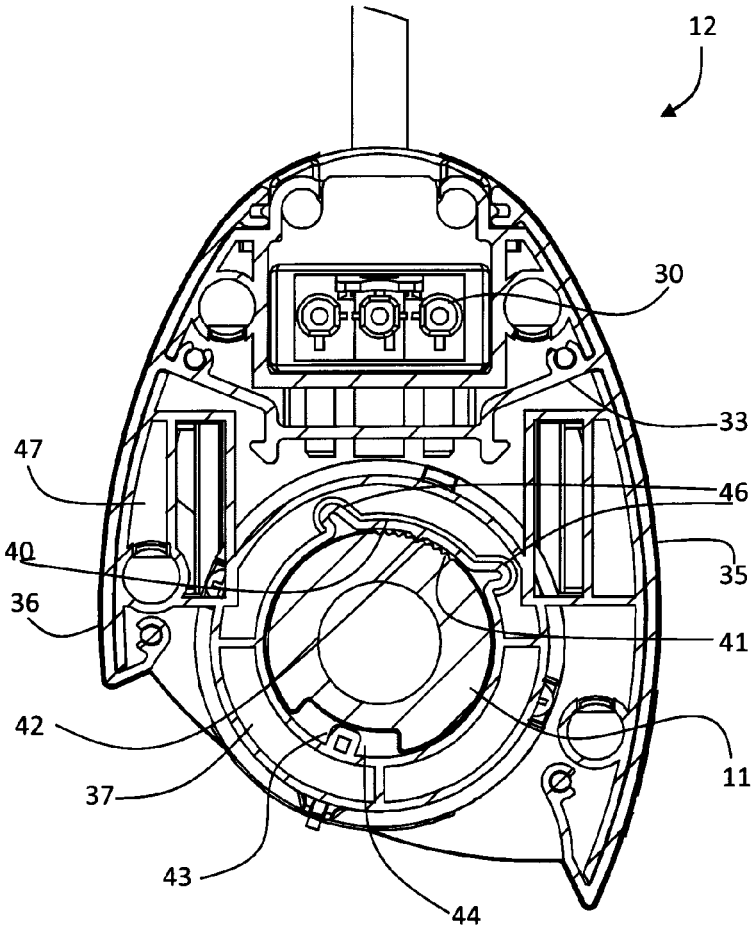
FIG. 2 is a front view of an end fixture of the illuminator.
Figure 3:
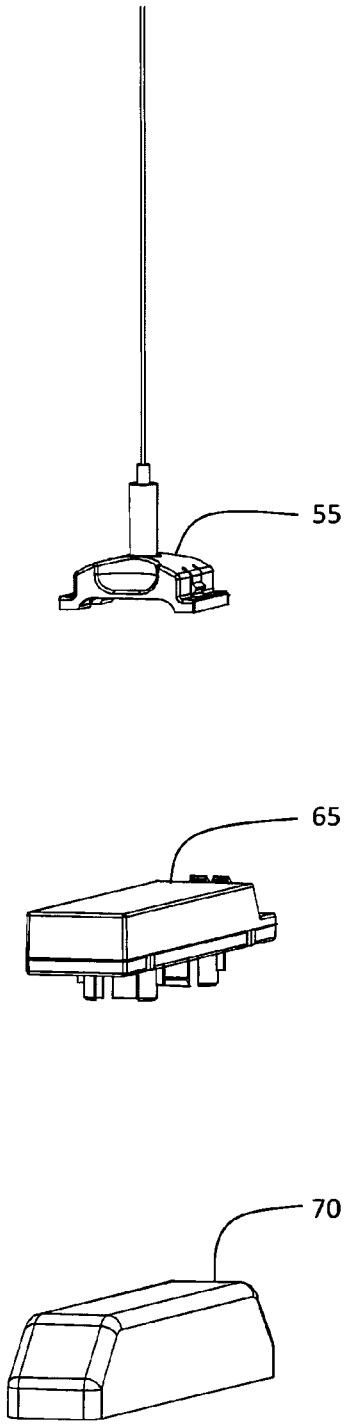
FIG. 3 shows parts which fit in an upper compartment of the outer housing.

Referring to FIGS. 1 to 4 an illuminator 1 of the invention comprises an outer housing 2 with unsymmetric side walls 3 and 4 interconnected by a top wall 5. The space above the wall 5 forms a compartment for a drive circuit and support fixtures. This compartment includes all of the mains power components.

An inner housing 10 (or "LED housing") fits within the outer housing 2. It has end caps 11 which fit into outer housing end fixtures 12, allowing rotation of the inner housing 10. The end fixtures 12 are covered at their ends by covers 13 and external trim 14.

The inner housing 10 contains an LED substrate 20 with LEDs 24, a reflector 21, a planar diffuser 22, and reflector baffles 23 along the length of the inner housing 10. The reflector 21 comprises a pair of curved symmetrical side walls 26. The reflector baffles 23 are of metal construction being clipped to and spanning the side walls 26

Each end fixture 12 comprises a wall 33 for engagement with the divider wall 5 of the outer housing, and side walls 35 and 36 corresponding to and engaging with the outer housing 2 side walls 4 and 3 respectively.

In more detail, the components in the top compartment of the outer housing 2 are in this embodiment:

30, input power (mains level) connector;

32, power terminal casing,

31, socket for the connector,

55, fixture for suspension of the illuminator 1,

65, power supply, and

70, circuit casing.

Each end fixture 12 includes a socket 37 to receive one of the rotary end caps 11 and allows the end cap 11 and the inner housing 10 to rotate. Each socket 37 comprises a curved wall 40 which is resiliently arranged due to two curved ends 46. Also, it has an inwardly-directed tooth 42. The tooth 42 engages in one of a series of discrete positions in a rack 41 of the rotary end cap 11. The socket 37 also has a stop piece 43 which fits in a circumferential slot 44 of the end cap 11. The length of the slot 44 governs the maximum degree of rotation of the end cap 11 in the socket. Such rotation has a number of discrete intermediate positions, governed by the configuration of the rack 41. In this case it has eight teeth, giving nine discrete rotary positions which are 5° apart between the extremes allowed by the slot 44.

The outer surface of the inner housing 10 has a high emissivity coating of matt black paint for a high level of radiation of heat from the inner housing. Both the inner and the outer surfaces of the outer housing 2 have a similar coating, thereby providing for very effective heat transfer out to the surrounding air. The final link for heat transfer is from the outer surface of the outer housing, this being a combination of radiation and convection, Within the inner housing 10, there is a series of LEDs 24 along the length of the substrate 20. These are each of 2 W power rating. The nature of the LEDs may be different, and in some embodiments there is a series of LED clusters along the length of the substrate. In one example, there is a single LED 24 at each position, of the GaN type with phosphors for setting the colour and colour temperature. Some or all of the LEDs may be white with tints of blue or green. Red LEDs may be mixed in clusters with white LEDs. The drive circuits provide individual control of each LED position (individual LED or cluster).

Whatever the colour(s) of the LEDs, they are of sufficient power to illuminate from a distance of at least 1.5 m, and in some embodiments from about 2.5 m to 3 m.

The wall 4 of the outer housing 2 extends down considerably more than the wall 3. It has a generally convex shape, the lower end 75 being turned inwardly and having an up-turned lip. T his lip 75 acts as a visor to limit light emitted laterally on this side and directly into a space which will be generally occupied by people. This outer housing 2 configuration allows the illuminator 1 to be located at a high position over an object to be illuminated, such as supermarket shelves. The wall 3 faces the shelves, while the wall 4 faces the aisle, hence optimally illuminating produce and blocking glare into the eyes of customers. Thus the outer housing 2 performs the multiple functions of housing the top compartment for mains power components and fixtures, accommodating the rotary inner housing with the LEDs, providing physical protection for the various components, of acting as a visor on one side to shield glare from people, and efficiently radiating heat due to it being of extrude aluminium and having the high emissivity coatings.

The inner housing 10 can be rotated for a desired range determined by the slot 44. This may for example be 40°. This allows excellent versatility, as the angle may be easily chosen according to the location of the object to be illuminated in relation to the location of the illuminator. It si only necessary to grip the inner housing 10 and rotate it. Moreover, as the inner housing 10 is modular in nature, it may be interchanged with one which has a wider or narrower opening. In one embodiment the inner housing 10 provides a beam angle of 29° and in another embodiment it is 42°

The reflector baffles 23 along the length of the inner housing 10 have a triangular configuration, and have textured surfaces. This allows excellent mixing of light along the axis of the illuminator. Also, they also act as visors for a person viewing in the longitudinal direction, maybe from beyond the end of an aisle.

Figure 4C:
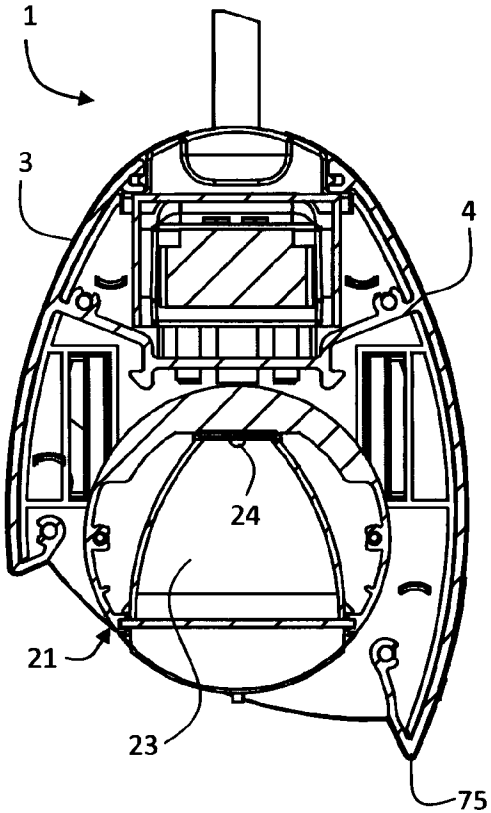
FIGS. 4(*a*) to 4(*c*) are cross-sectional views through the illuminator, showing three different illumination settings.
Figure 4B:
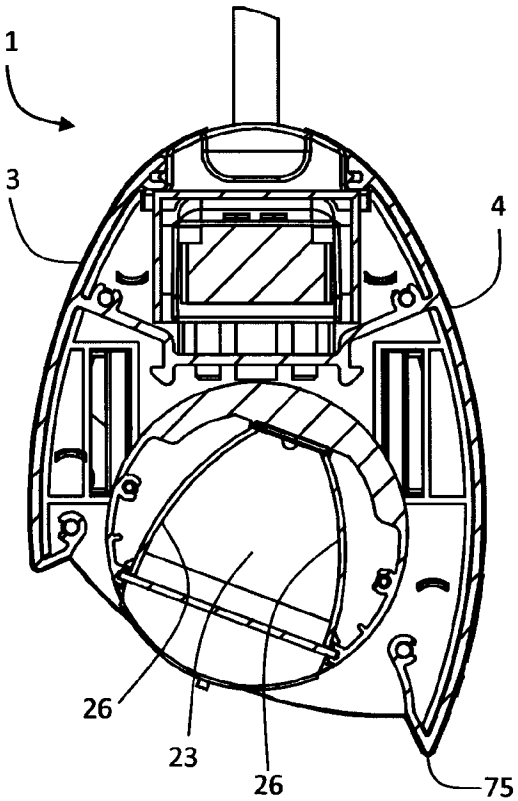
Figure 4A:
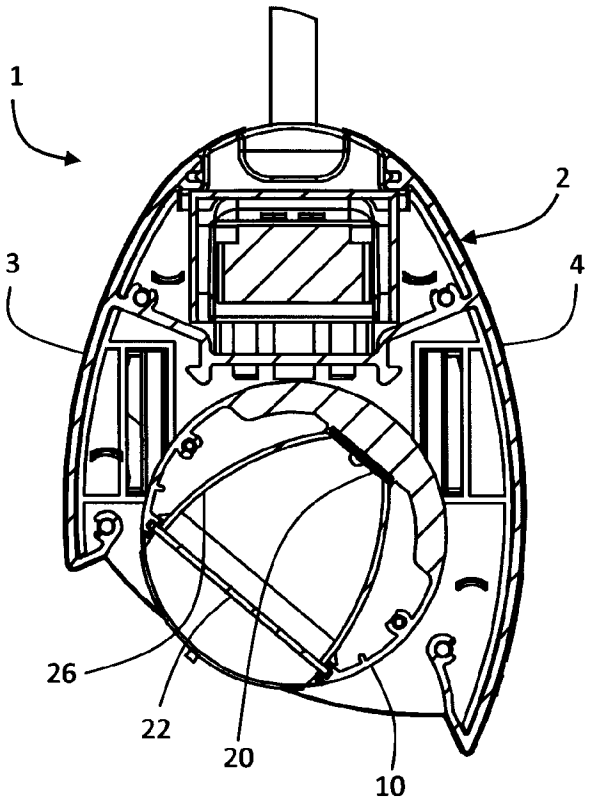

FIGS. 5 to 8 give examples of how the illuminator is very advantageous for a range of retail applications where high power illumination from a distance of at least 1.5 m is required. The angle to vertical may be changed by rotation of the inner housing 10, as shown in FIGS. 4(*a*), 4(*b*), and 4(*c*).

Figure 5:
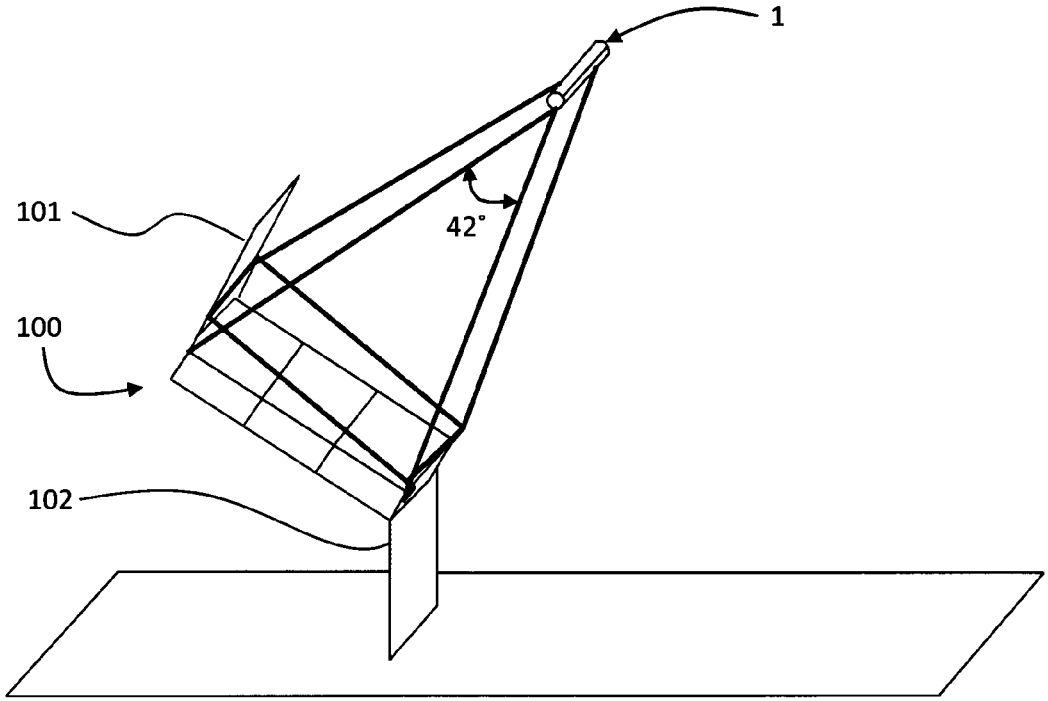
FIGS. 5 to 8 are diagrams illustrating use of the illuminator 1 in various retailing scenarios.
Figure 6:
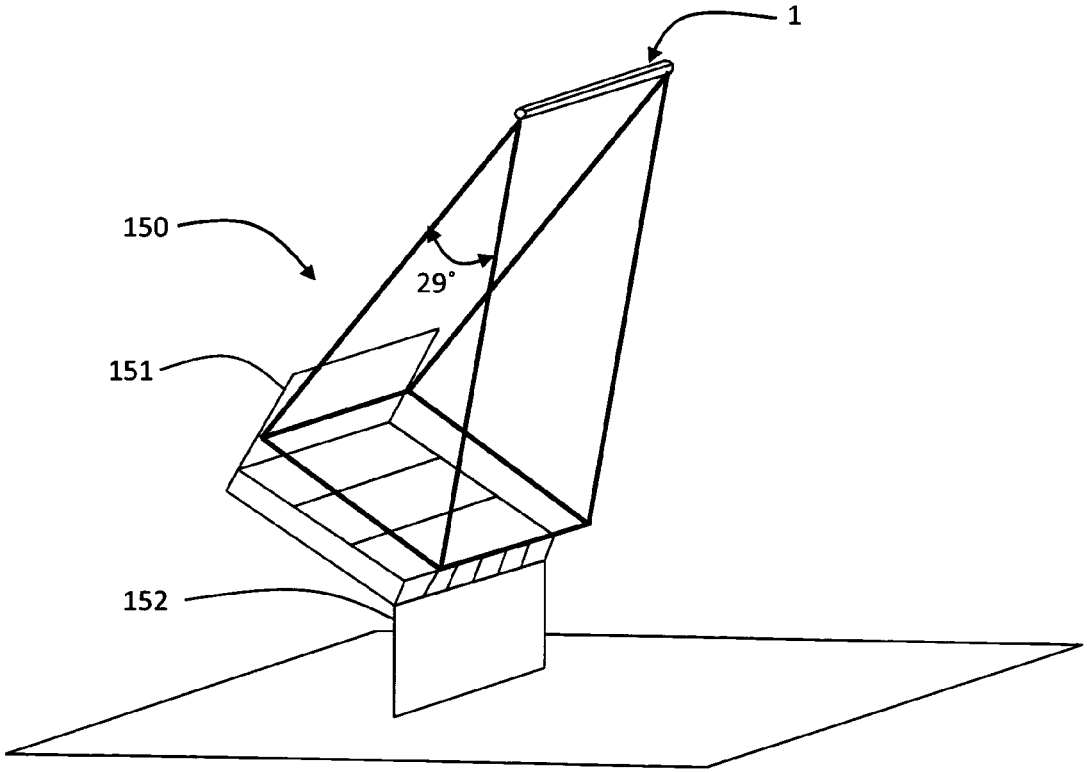
Figure 7:
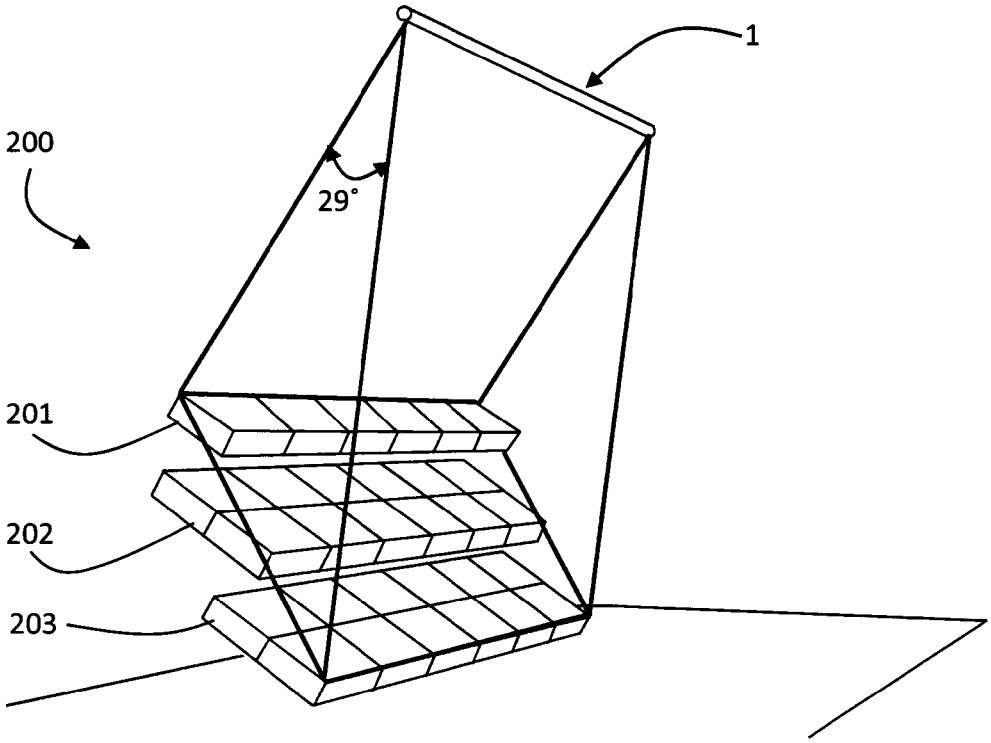
Figure 8:
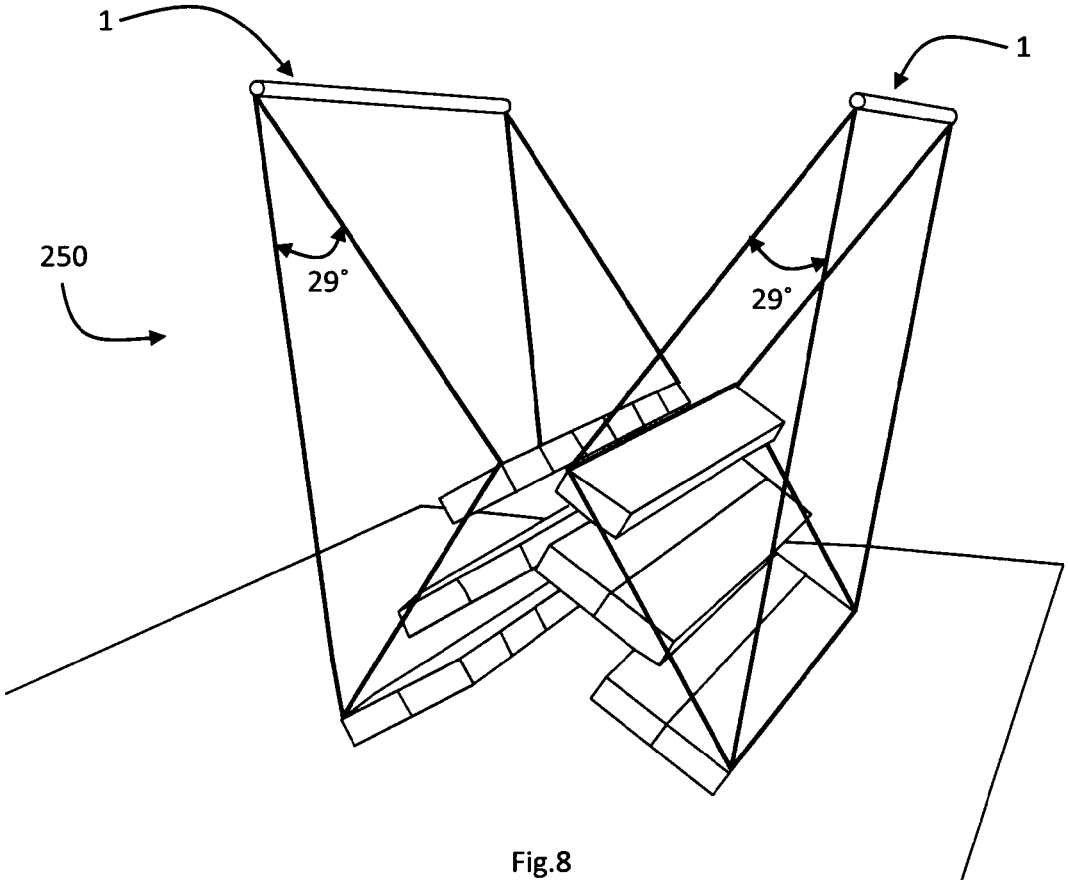

In FIGS. 5 and 6 the illuminator 1 is at heights of 2.5 m and 3.5 m respectively. For the lower setting shown in FIG. 5 there is a bam width of 42° governed by the separation of the reflector walls 26 of the inner housing. The illuminator 1 illuminates a shelving system 100 having a back mirror and a vertical stand 102. In FIG. 6 the illuminator 1 has a beam width of 29° and illuminates a display system 150 having a back reflector 151 and a stand 153. As shown in FIG. 7 the illuminator 1 is at a higher level and the beam width incident on the object is 29°, in this case a retail display 200 having upper middle and lower shelves 201, 202, and 203. FIG. 8 shows how a pair of illuminators 1 can be used to illuminate opposed display systems 250.

Figure 9:
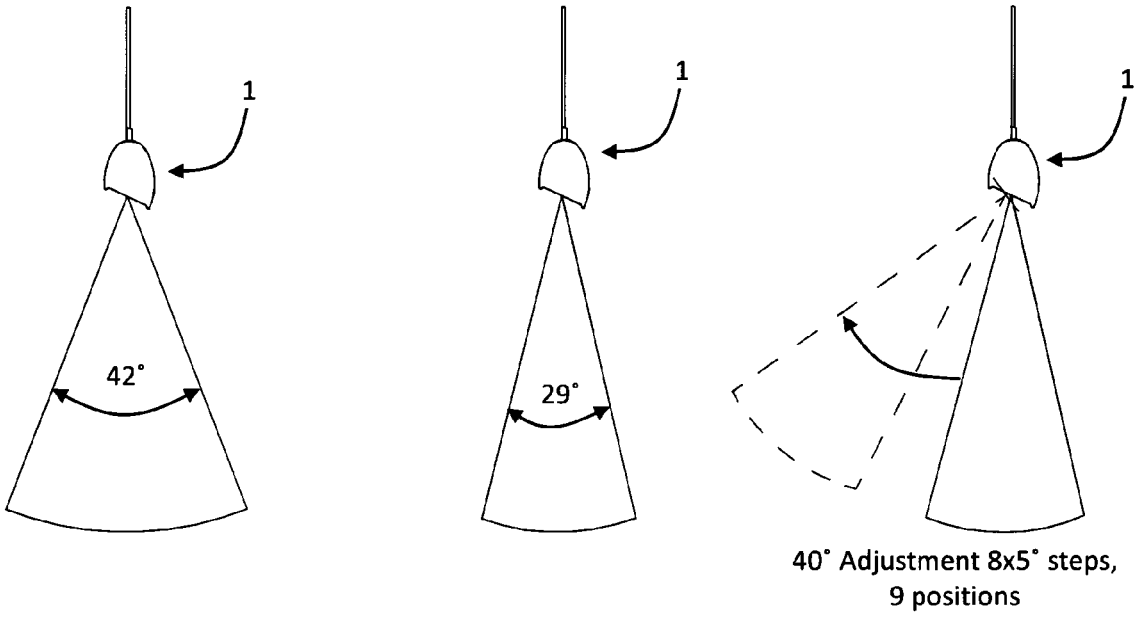
FIG. 9 is a set of three diagrams showing versatility in illumination range.

FIG. 9 shows the different maximum range of rotation options: 42° or 29°. This can be set by choice of inner housing 10. This is typically at installation, but could be done at any stage by a technician. As shown in the right hand side diagram the location of the beam may be easily moved by simply rotating the inner housing 10.

Where long runs of interconnected luminiares are installed it is possible to adjust the angle of illumination in each 1.2 m segment separately as the displays being lit may change in location/shape and produce being displayed. It is also possible to separately control or set the colour of the white light emanating from each segment. The outward appearance of the line of suspended luminaires remains vertical and even in appearance. The uniform vertical suspension of the exterior case means that these can be integrated electrical connections between individual luminiares to speed installation.

The illuminator 1 is passively cooled, thus avoiding the cost and the reliability issues associated with fans and other forms of assisted cooling.

The coatings on the extruded metal surfaces ensure that thermal energy is optimally coupled to the surrounding air. This allows the system to operate at very high optical power without compromising the lifetime of the LEDs and the overall product performance, reliability and stability. The outer profile of the extrusion provides a large surface area and shape that optimally allows heat to be convected into the surrounding air.

In some embodiments, the illuminator allows for adjustment of the light output in colour and/or in intensity using a pushbutton on the unit or using a remote control unit where the unit's button is inaccessible. This colour tuning allows for the matching of the light output to the type of produce on display. For example, red meats appear more attractive under light that is "warmer" in colour and frozen products are preferred under "cooler" lighting. The design also allows (some versions) for control of these features via an auxiliary electrical interface.

The light beam is sharply defined and closely confined so that the possibility of direct spill into shopper's or employees eyes is minimised. The lower visor edge 75 of the outer housing wall 4 is installed so that it is between the customer and the brightest light sources. Because of this, the customer has to be "under the light" to see into the sources.

The optical reflectors 23 are arranged so that their surfaces are highly specular and reflect almost all of the light. This scatter is visible from outside the beam. This is desirable as it indicates that there is light coming from the source but does not interfere with customer's view of the produce or market. Shaped louvres or baffles at each group of LEDs prevent direct light from escaping at more than 40° to the horizontal.

A modular construction of the illuminator 1 allows for easy configuration of optical beam widths by simply substituting a different reflector.

Because the illuminator is linear and has a high length to width ratio it is effectively divergent in only one plane. Because of this, the illuminance falls off (only) linearly with distance from illuminated target (twice as distant=2 times dimmer). This makes the illuminance less dark for a more distant source compared to the behaviour of a spot or conically focussed product.

The illuminator 1 is designed to deliver uniform and optimally matched lighting to displays of food and other retail goods especially where such displays are linear in nature. It is designed to be used in a horizontal orientation mounted above and in front of the goods to be displayed. Preferably the luminaire or array of luminaires is placed is a position that is relatively perpendicular to the orientation of the shelving or product.

The reflectors 23 are textured mirror-like reflectors that are aligned at an angle close to that of the desired beamwidth. The base of the reflectors are arranged to be as close as possible to the LED sources so that they collect and reflect forward all of the rays of light emitted by the LED sources. The majority of these rays of light, radially exiting each of the LED sources (in all dimensions), are reflected either once or severally by these long textured reflectors 23 producing a beam in the general shape of an extruded triangle whose beamwidth is close in angle to the angle between the polished reflectors. The reflectors 23 and the LED substrate 20 control the straightness and precision of alignment (in height) with the line of LEDs and the LED substrate. The series of diffusely reflecting baffles or reflectors 23 are placed at regular intervals so as to limit and control direct glare from the LEDs exiting at shallow angles close to the axis of the illuminator 1. The heights of and distances between the baffles 23 may be adjusted from one product to another in order to set the blocking angle. The distance or pitch between the baffles may be chosen to match the distance between the LEDs so as to improve the uniformity of the appearance of the luminaire A line of small LEDs may be attached to a metal clad or other thermally conductive substrate with electrical conductors. The LEDs may be of different colours arranged in such a manner as to mix the light as much as possible and make the appearance of the light and goods uniform.

The elongate diffuser 22 consists of a lenticular array of small cylindrical lenses or grooves that are generally perpendicular to the axis of the line of the LEDs. The diffuser acts so that is spreads or smears the sources along that axis so that it reduces the apparent luminosity of the sources to a more acceptable level. At the same time it causes little or no dispersion of the light in the plane perpendicular to the luminaire thereby preserving the high optical efficiency conferred by the reflector baffle arrangement and the linear illuminance falls off with distance referred to above.

Because the illuminance has a very sharp cut-off, in conjunction with a very small (linear) source, glare is reduced. There may be an integrated personnel detector in the housing. The controller may vary light output in a way that is invisible to customers. This may include PWM schemes using software rules that take full advantage of the asymmetric and complex response of the eye/brain to increase and decrease light levels. The illuminator may be in a self-configuring wireless network between lights that allow luminaries to communicate/perfect their response to shoppers and provide their operational status to a store owner, manager or controller.

The illuminator may have an adjustable beam width/cut-off. The distance between the reflectors 23 and/or 26 may be adjustable, to make configuration easier and allow better optical control, easier installation, and further energy saving. The illuminator may include a camera allowing features such as personnel counting, automatic and continuous monitoring, and reporting of shopping directions and trends.

The invention is not limited to the embodiments described but may be varied in construction and detail. The reflector baffles may be curved across their short dimension in some embodiments. They are represented as flat in a drawings and representation.

The invention claimed is:

1. An illuminator comprising:

an elongate inner housing having a substrate on which there is a linear array of light emitting diodes, wherein the diodes have sufficient power for illuminating objects at a distance of at least 1.5 m, a drive circuit or a connector to a drive circuit, and an outer housing at least partly surrounding the inner housing, wherein the illuminator further comprises a pair of side reflectors extending substantially parallel to an axis of the illuminator, and said reflectors are side walls of the inner housing, wherein the illuminator further comprises a series of reflector baffles extending from a plane of the diodes at intervals along the length of the inner housing, wherein the inner housing is rotatably mounted within the outer housing by a coupler, and wherein a first side wall of the outer housing extends further away from the diodes than the outer side wall, said first side wall lower edge forming a visor to limit lateral glare.

2. The illuminator as claimed in claim 1, wherein the illuminator further comprises a diffuser over the diodes.

3. The illuminator as claimed in claim 1, wherein the illuminator further comprises a diffuser over the diodes; and wherein the diffuser comprises a lenticular array of small cylindrical lenses.

4. The illuminator as claimed in claim 1, wherein the illuminator further comprises a diffuser over the diodes; and wherein the diffuser is of overall rectangular shape extending along the length of the illuminator inner housing.

5. The illuminator as claimed in claim 1, wherein the illuminator further comprises a diffuser over the diodes; and wherein the diffuser is curved along the direction of the axis of the small cylinder lenses so as to minimise Fresnel losses.

6. The illuminator as claimed in claim 1, wherein the diodes include red, white and green diodes interspersed in a pattern.

7. The illuminator as claimed in claim 1, wherein the diodes include white-only, or white and red, or white and red and green diodes.

8. The illuminator as claimed in claim 1, wherein the inner housing is coupled to the outer housing in a modular manner so that it is interchangeable.

9. The illuminator as claimed in claim 1, wherein the baffles have textured surfaces.

10. The illuminator as claimed in claim 1, wherein the baffles diverge from associated diodes.

11. The illuminator as claimed in claim 1, wherein each baffle has a triangular configuration, opposed faces of which are for juxtaposed diodes.

12. The illuminator as claimed in claim 1, wherein the baffles have a dimension normal to the substrate sufficient to act as visors to limit glare in the longitudinal direction.

13. The illuminator as claimed in claim 1, wherein the outer housing has a top wall and side walls.

14. The illuminator as claimed in claim 1, wherein the outer housing side walls are curved with a convex shape, curved inwardly at their lower edges.

15. The illuminator as claimed in claim 1, wherein the coupler is adapted to allow a limited range of rotation.

16. The illuminator as claimed in claim 1, wherein said range is set by engagement of a stop piece in a slot between the inner housing and the outer housing.

17. The illuminator as claimed in claim 1, wherein the coupler comprises an inner housing end cap at each end and an outer housing fixture at each end, the end cap and the fixture at each end being configured for rotary inter-engagement.

18. The illuminator as claimed in claim 1, wherein the inner housing is rotatably mounted within the outer housing by a coupler; and wherein the coupler includes a resilient latch arranged to engage a receiver at any of a plurality of discrete positions, providing stepped mutual rotation.

19. The illuminator as claimed in claim 1, wherein the outer housing has a top wall and side walls wherein the outer housing side walls and top wall define an upper compartment housing at least a higher voltage part of the drive circuit and support fixtures.

20. The illuminator as claimed in claim 1, wherein an outer surface of the inner housing and both inner and outer surfaces of the outer housing have high emissivity coatings.

* * * * *